US005148935A

United States Patent [19]

Lyon

[11] Patent Number: 5,148,935

[45] Date of Patent: Sep. 22, 1992

[54] VENTING RESEALABLE CONTAINER CLOSURE AND ASSOCIATED CLOSURE CONTAINER-COMBINATION

[75] Inventor: Jay W. Lyon, Greensburg, Pa.

[73] Assignee: Aluminum Company of America, Pittsburgh, Pa.

[21] Appl. No.: 601,453

[22] Filed: Oct. 22, 1990

[51] Int. Cl.[5] ..... B65D 51/16

[52] U.S. Cl. ..... 220/208; 220/203; 220/258; 220/259; 220/266; 220/268; 220/278; 220/306; 220/336; 220/366

[58] Field of Search ..... 220/203, 204, 208, 209, 220/231, 254, 258, 259, 266, 267, 268, 277, 278, 306, 336, 366, 367, 89.2, 89.3; 215/260

[56] References Cited

U.S. PATENT DOCUMENTS

| | | | |
|---|---|---|---|
| 3,373,889 | 3/1968 | Giles | 215/260 X |
| 3,393,818 | 7/1968 | McIntosh | 215/260 |
| 3,651,981 | 3/1972 | Kinney | 220/366 X |
| 3,762,595 | 10/1973 | Green et al. | 220/209 |
| 3,929,251 | 12/1975 | Urmston . | |
| 3,938,693 | 2/1976 | Patel et al. | 220/267 |
| 3,977,341 | 8/1976 | Jordan et al. . | |
| 3,997,076 | 12/1976 | Jordan . | |
| 4,024,981 | 5/1977 | Brown . | |
| 4,148,410 | 4/1979 | Brown . | |
| 4,463,866 | 8/1984 | Mandel | 220/269 |
| 4,580,692 | 4/1986 | La Barge et al. . | |
| 4,648,528 | 5/1987 | La Barge et al. . | |
| 4,673,099 | 6/1987 | Wells | 220/269 |
| 4,685,849 | 8/1987 | La Barge et al. . | |
| 4,783,985 | 11/1988 | La Barge et al. . | |
| 4,799,598 | 1/1989 | McFadyen | 215/260 |
| 4,865,215 | 9/1989 | Wells | 220/269 |
| 4,928,844 | 5/1990 | La Barge . | |
| 4,930,655 | 6/1990 | Wells | 220/258 |
| 4,932,555 | 6/1990 | La Barge . | |
| 4,957,216 | 9/1990 | LaBarge | 220/379 |
| 4,982,862 | 1/1991 | LaBarge | 220/278 |
| 4,991,732 | 2/1991 | LaBarge et al. | 215/260 |
| 4,993,572 | 2/1991 | Ochs | 215/260 |

OTHER PUBLICATIONS

W. Coy Willis, Scott C. Biondich, U.S. Pat. application Ser. No. 397,218 filed Aug. 23, 1989 now abandoned, Titled: Resealable Container Closure.

*Primary Examiner*—Stephen Marcus
*Assistant Examiner*—Stephen Cronin

[57] ABSTRACT

A cap for substantially gas-tight sealing engagement with a container wall having an opening therein circumscribed by a sealing surface has an end wall and a depending skirt with a portion for securing the cap to a container wall, and a tab for manual engagement to rotate the cap between a container wall sealing surface engaging position and a storage position. The cap has a vent region provided by a weakened zone that is preferably located on or near the tab. The weakened area may include removal of a portion of the cap skirt, thinning a portion of the cap skirt, variations in wall thickness of portions of the cap skirt or top wall in a predetermined manner, configurating the portion of the tab which connects with the cap in such a manner as to facilitate ready circumferential expansion of the cap. Combinations of these weakening features may be employed. The cap is adapted once in gas-tight sealing engagement with the sealing surface of the container wall to vent in the weakened zone upon predetermined internal container, pressure being attained and, subsequently, automatically resealed. A container in combination with such a cap is also disclosed.

46 Claims, 3 Drawing Sheets

VENTING RESEALABLE CONTAINER CLOSURE AND ASSOCIATED CLOSURE CONTAINER-COMBINATION

BACKGROUND OF THE INVENTION

1. Field of the Invention

The present invention relates to a resealable, easy open container wall, such as a can end. More particularly, the present invention relates to a resealable closure cap and a container cap assembly easily applied to a spout of a container wall which is capable of accommodating desired internal container pressures.

2. Description of the Prior Art

The prior art teaches various structures for containers such as drawn and ironed cans having end panels which have opening devices which are generally called "easy open ends" double seamed to the can. Examples of easy open ends of the prior art are described in U.S. Pat. Nos. 3,929,251; 3,977,341; 3,997,076; 4,024,981; and 4,148,410.

The market for containers having easy open ends may be extended, particularly, though not exclusively, with respect to containers having larger capacities. This may be accomplished through the utilization of a cap to close and reseal the spout or pouring opening defined by the easy open end. Without a resealable closure cap, the liquid contents of an open container could easily spill or be otherwise lost. Also, dissociable gases, i.e., carbonation, in the remaining liquid are readily lost from unsealed, open containers, thereby altering the character of the product.

One construction for a resealable closure cap assembly is taught in U.S. Pat. No. 4,580,692. See also U.S. Pat. Nos. 4,685,849 and 4,783,985. These patents teach constructions for such a resealable closure cap assembly in association with a selectively contoured can end to accommodate the resealable closure while retaining the advantages characteristic of the easy open end. These patents disclose a sealing cap having a seal portion, an arm for securement to the container wall by means such as a rivet and a tab for use in grasping the cap to move it from one position to another. The cap is generally circular and has the arm emerging therefrom at a position generally about 90° degrees offset from the place where the tab projects outwardly.

U.S. patent application Ser. No. 338,096 U.S. Pat. No. 4,991,732 discloses venting of such a resealing cap during removal of the resealing cap from the container so as to resist undesired reverse displacement of the container wall end panel which would establish a potentially serious hazard. This application discloses the use of venting channels which are transversely located in an inwardly directed ledge of the closure. See generally U.S. Pat. No. 4,928,844.

U.S. Pat. No. 4,932,555 discloses such a system which creates zones of weakness between the cap and the rivet securing the arm connecting the cap with the rivet.

U.S. patent application Ser. No. 338,310 U.S. Pat. No. 4,982,862 is directed toward such a system wherein improvements are provided to the container wall spout.

U.S. patent application Ser. No. 338,580 U.S. Pat. No. 4,957,216 discloses a releasable fastening assembly in the form of an additional projection from the cap which is adapted to cooperate with a button-like member formed in a container wall to resist undesired rotation of the cap.

U.S. patent application No. 397,218 Abn. discloses the use of a plurality of stiffening ribs in such a reclosure cap so as to provide zones of different elasticity from other zones. It also discloses the absence of such ribs in the region connecting the arm which secures the cap to the container and the remainder of the cap. It also contemplates the possible omission of ribs from the region adjacent the arm in order to provide for venting in this region.

The disclosures of all of these U.S. patents and copending United States patent applications are expressly incorporated herein by reference.

The provision of commercially acceptable resealable easy open can end constructions for current and larger volume beverage containers requires ease of application of the resealing cap over the spout, sealed retention of remaining container contents and accommodation of inherent internal can pressure that builds after resealing the can. Also desired is a can end configuration having an easy open end which does not require the use of lever mechanisms or the like to accomplish opening of the pouring spout. Ideally, the easy open end is easily and readily opened by a user through the mere application of digital pressure in a simple and safe manner. Such construction of a resealable easy open can end should be accomplished without diminution of the convenience and cost effective nature of the basic easy open end construction during manufacturing, filling, handling, shipping, distributing, selling and consumer usage.

Experience to date with resealable caps and can end constructions, such as those disclosed in U.S. Pat. Nos. 4,580,692 and 4,648,528, the contents of which are incorporated herein by reference, has indicated a need to assure proper application and retention of the resealable cap over the spout defined by the easy open end.

Despite attempts and progress in this area of resealable container closures, there is still a need and a demand for further improvement. Accordingly, a new and improved resealable container closure is desired which is easily applied to the spout to provide an effective seal for an opened container.

SUMMARY OF THE INVENTION

The present invention provides a closure cap for substantially gas-tight sealing engagement with a container closure having an opening therein circumscribed by a substantially smooth sealing surface thereon. The closure cap includes a sealing portion releasibly engageable in surrounding gas-tight sealing relation with the sealing surface on the container closure. The sealing portion may have elastic portions circumferentially spaced by a plurality of radially extending less elastic portions. The cap assembly of this invention may be anchored to the end wall of a sheet metal container.

It is an object of this invention to provide an improved construction for a resealable container closure for easy open and beverage containers and the like.

It is an object of this invention to provide a resealable container closure for a can which is easily and effectively applied over an open spout on a can end.

It is an object of the present invention to provide a resealable container closure for a can which, when applied over an open spout, creates and maintains an effective seal to hold the contents at the desired internal can pressure.

It is a further object of this invention to provide an effective closing and sealing mechanism for a can end which allows the use of larger volume containers because such containers may be effectively sealed to retain carbonation over longer storage periods required to consume such larger volumes of container contents.

It is another object of the present invention to provide automatic venting so as to resist potentially unsafe explosive and violent venting of such container constructions.

It is a further object of the present invention to provide such a cap-container combination which will facilitate automatic venting of the cap when the internal container pressure exceeds a desired predetermined maximum and automatic reseating of the cap to sealed position thereafter.

It is a further object of the present invention to provide such a cap which does not require the use of vent openings passing through the cap.

It is a further object of the present invention to provide such venting at a weakened region of the closure cap by local cap deformation thereof.

It is another object of this invention to provide such a system which is economical and convenient to manufacture and use.

It is another object of the invention to provide such a system which will be easy for the consumer to use without any special technical skills or manual dexterity.

These and other objects of the invention will be more fully understood from the following description of the invention, on reference to the illustrations appended hereto.

DETAILED DESCRIPTION OF THE INVENTION

The present invention is described in association with a resealable easy open end construction of the type generally disclosed in U.S. Pat. Nos. 4,580,692 and 4,648,528. However, it should be understood that the present invention is not limited to that construction and may be used in other easy open can end constructions.

Where the words "upwardly," "downwardly," "inwardly," "outwardly," "under," "underside," "and like words of orientation are used in this application, unless specifically indicated to the contrary, they are to be applied with reference to a can or other container standing on its base in an upright position having a can end incorporating this invention attached to the top end thereof.

Figure 1:
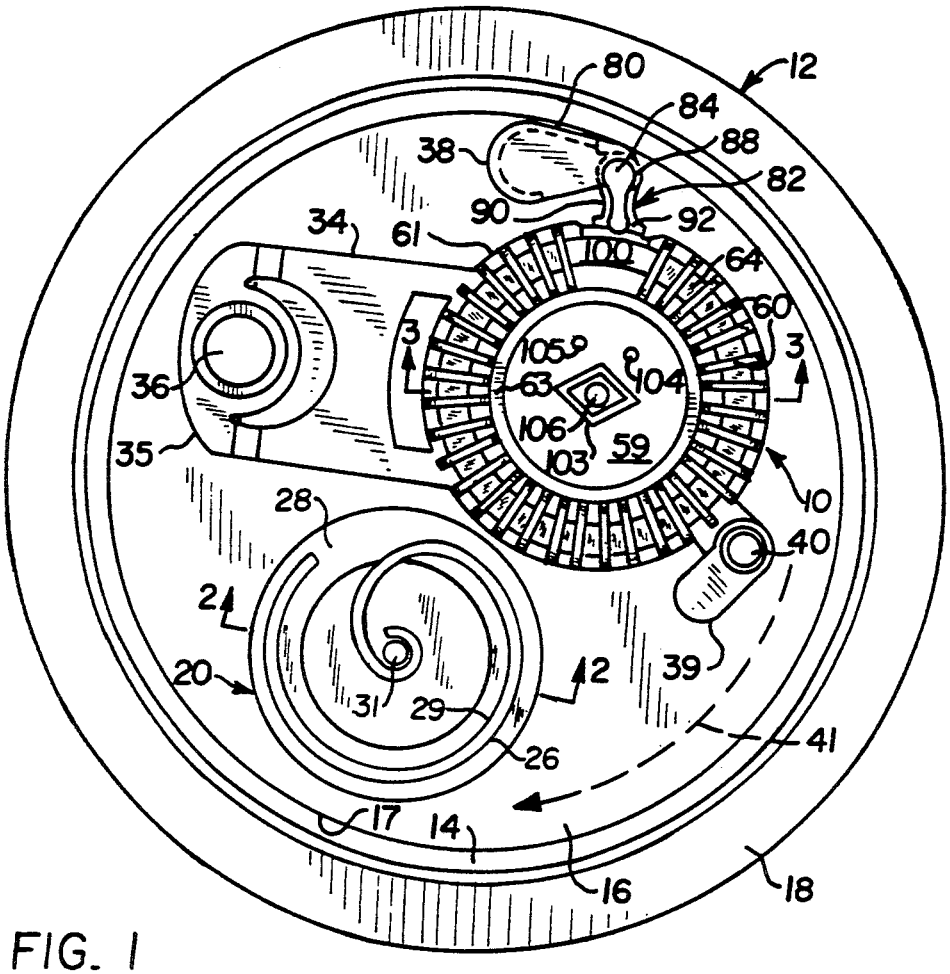
FIG. 1 is a top plan view of an easy open can end construction having the cap and container wall combination of this invention.

Referring more particularly to the drawings, FIG. 1 illustrates a top plan view of an easy open can end construction incorporating the principles of this invention. FIG. 1 shows a can end closure 12 prior to securement of the can end closure to the top end of a generally cylindrical can body, such as by conventional double seaming, for example. Such can end closure 12 is generally made of sheet metal such as aluminum, steel or tinplate, but may be made of nonmetallic or laminated material. The closure 12 includes a generally flat or planar end wall 16, a countersink defining an inner panel wall 17, and an outer chuckwall 14 terminating in an upwardly and outwardly projecting annular flange 18 forming a chime for conventional attachment of the sheet metal can end 12 to a can body by double seaming.

Figure 2:
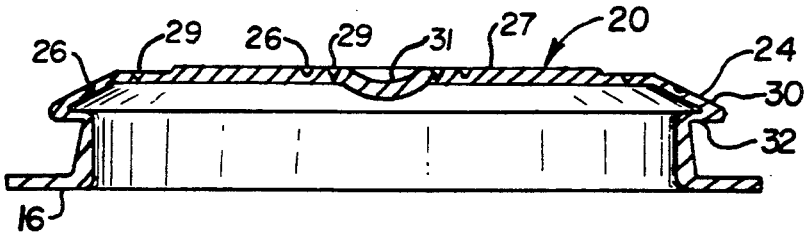
FIG. 2 is a cross-sectional illustration of the portion of the container wall adapted to be open for dispensing the container contents.

As best shown in FIGS. 1 and 2, the can end closure 12 further includes an upwardly projecting dispensing spout 20 or pouring opening. The spout 20 is typically of circular configuration and is formed as an integral portion of the can end closure 12. Although the preferred spout 20 is circular, it should be understood that alternate configurations, including oval, teardrop and ellipsoidal shapes, or other desired shapes may be employed with the present invention. The spout 20 may include a removable panel 27 defined by a pair of spiral score lines 26, 29 or any other desired score line pattern. The central portion 31 of panel 27 has an upwardly concave depressed section adjacent to score lines 26, 29. The score lines 26, 29 are interrupted by a hinge 28, but otherwise the score lines 26, 29 circumscribes and define an opening panel 27 which is depressible inwardly into the can upon progressive fracture of the score lines 26, 29. The opening panel 27 and the score lines 26, 29 are surrounded by a continuous lip 24 having substantially smooth sealing surfaces 30 and 32 to which the resealing cap 10 will be secured. In the preferred embodiment, the lip 24 is circular in plan.

As shown in the drawings, the present invention has a resealing cap 10 which is adapted to be positioned over the lip 24 to seal the spout 20 after opening. The cap 10 is preferably molded in one piece of a resinous material having a relatively low modulus of elasticity, such as, for example, low density polyethylene, polyvinyl, polyester, polyurethane or nylon. In addition to a low modulus of elasticity, suitable cap materials typically exhibit thermal and dimensional stability, chemical resistance, strength and durability.

As shown in FIGS. 3–6 the resealing cap 10 includes a top panel 59 and a depending skirt 61 which has a sealing portion defining an inwardly open annular locking recess 68, adapted to be placed in sealing overlying relationship over the opening in spout 20 and in sealed engagement with sealing surfaces 30, 32. The cap 10 also includes an integral tab 38 projecting generally radially outwardly from the cap skirt 61 and has a generally circumferentially oriented gripping portion to facilitate digitally manipulating the cap 10. In a preferred embodiment an integrally formed, generally radially extending arm 34 extends generally radially from the cap skirt 61 at a position generally 90° degrees offset from tab 38 in the form shown and terminates in a boss 35. The boss 35 has an opening 37 therethrough to accommodate a rivet 36 (FIG. 1) for pivotally securing the cap assembly 10 to the can end wall 12. An example of an alternate lid to which the cap assembly of this invention may be applied, such as by an integral rivet, is described in U.S. Pat. No. 4,890,759. The cap 10 preferably has a plurality of alternating radial sections having relatively reduced thickness with respect to adjacent radial sections. These relative thicknesses may be achieved by providing radial zones of lesser thickness than the remaining alternating zones. For convenience of reference herein, this construction will be considered as having a plurality of outwardly projecting ribs 60 extending from the top panel 59 into skirt 61 and are relatively spaced by unribbed thinner portions 64. An upwardly open annular channel 63 separates the inner portion of top panel 59 from the radially outer rib containing portion thereof.

The outer portion of a flange of the rivet 36 (FIG. 1) is formed downwardly a controlled amount when the rivet 36 is staked to securely attach the cap assembly 10 to the can end closure 12. The rivet 36 also permits the cap 10 to be rotated by hand about the rivet 36 with relative ease as indicated by dotted line 41. Preferably the rivet is an integrally formed portion of a sheet metal end wall 16 created in a manner well known to those skilled in the art.

Tab 39 (FIGS. 1 and 4) which is integrally formed with the cap 10 and projects generally radially outwardly from cap skirt 61, and has a generally circumferential gripping tab extension, has a portion which is frictionally engaged with bubble 40 formed within and projecting out of the container end wall, and serves to resist undesired rotation of the cap about rivet 36. Details of such construction, which form no part of the present invention, are illustrated in co-pending U.S. patent application 38,580.

Figure 3:
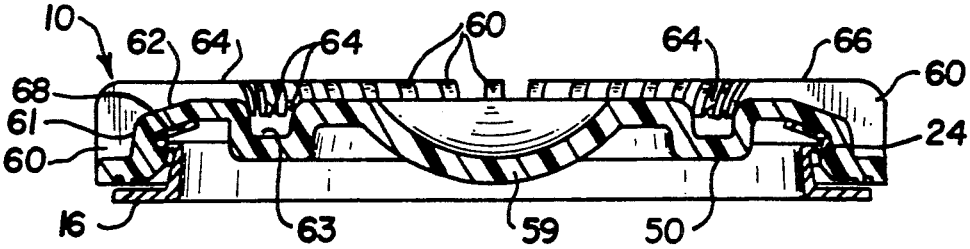
FIG. 3 is a cross-sectional illustration taken through 3—3 of FIG. 1 showing the cap in overlying relationship with respect to the portion which has been opened to create a pour spout.
Figure 4:
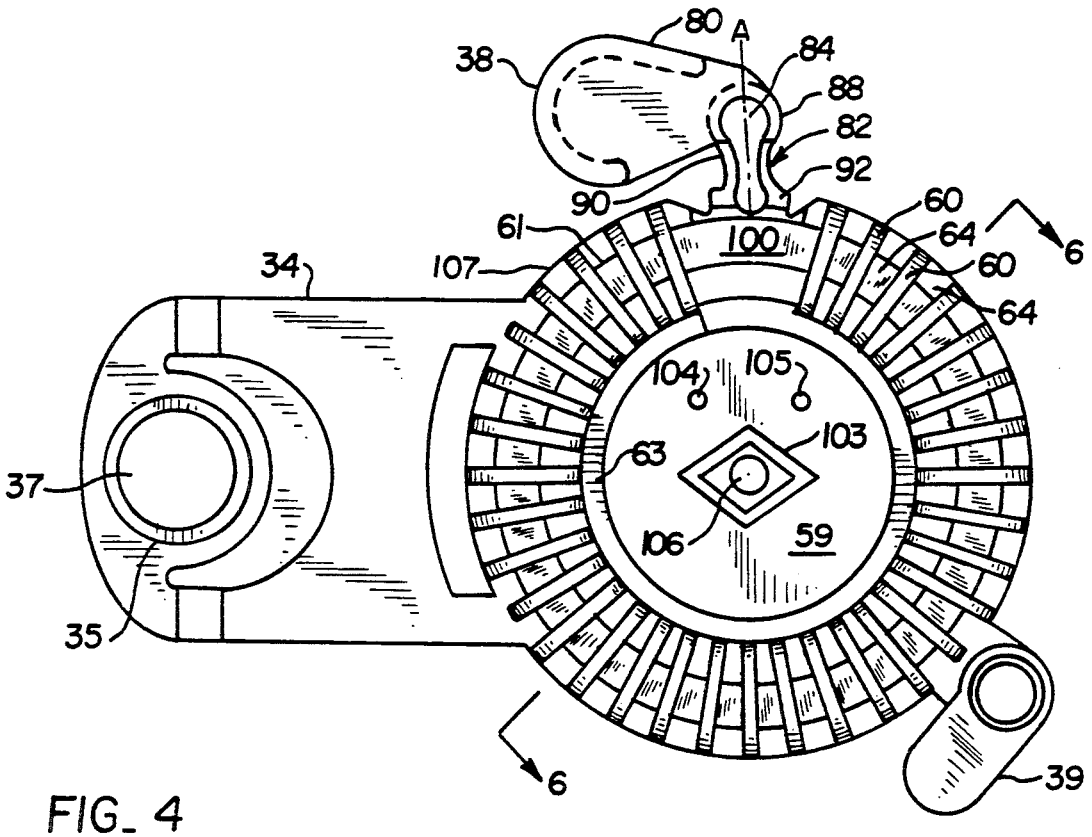
FIG. 4 is a top plan view of one form of the cap of the present invention.

As shown in FIGS. 1 and 4, the tab means 38 which are adapted to be manually engaged in lifting the cap so as to rotate the same between a container sealing position (FIG. 3) and a storage position (FIG. 1) is preferably integrally formed with the cap. The tab means 38 projects generally radially from the cap skirt 61 and consists of a gripping portion 80 and a connecting portion 82 which is connected to cap skirt 61. In the form illustrated, the connecting portion 82 has a generally hourglass shape which surrounds a central opening 84. The portion which is connected to the gripping portion 80 is enlarged with respect to intermediate portion 90 and is of lesser transverse extent than the portion 92 which is connected to the main body of the cap. This hourglass configuration of the connecting portion 82 and opening 84 provides a very flexible construction so as to facilitate flexing thereof and localized deformation which creates a venting action in this region of the closure cap.

As will be discussed in greater detail hereinafter, the present invention provides a closure cap which will automatically vent in a weakened region at a predetermined pressure. After venting, the closure cap will automatically reseat itself in sealed position. This is accomplished by creating a zone of weakness in the closure cap, preferably in the general region where tab means 38 connects to cap skirt 61. This zone of weakness facilitates local venting when the predetermined pressure is reached. Numerous means for providing such zone of weakness may be employed alone or in various combinations.

Shown in FIG. 4 is a region 100 of the top panel 59 and depending skirt 61 of the cap. This region 100 is preferably devoid of ribs. This results in region 100 being more flexible than other comparably sized zones of the cap and will serve in a manner described hereinafter to facilitate circumferential expansion of the closure skirt during venting. The hourglass shape of the tab connecting means 88 similarly serves to facilitate this.

Figure 6:
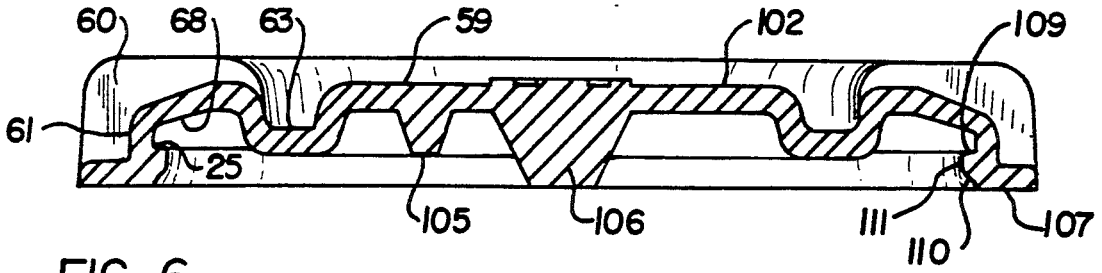
FIG. 6 is a cross-sectional illustration of the cap of the invention taken through 6—6 of FIG. 4.

As shown in FIGS. 4 and 6, the top wall 59 has a central region which is essentially devoid of ribs 60 and has a diamond shaped portion 103 underlying which is a downwardly projecting boss 106 which in a manner taught by the prior art serves to facilitate fracture of container wall score line 26 by positioning the cap in overlying relationship with respect to opening panel 27 and manually pressing downwardly in the region of the diamond 104. In a preferred form, additional downwardly projecting bosses 104, 105 serve to enhance this opening action.

In a preferred embodiment of the invention, the region 100 will be symmetrical about or centered on the centerline A (FIGS. 4 and 10) of tab connecting means 82 and will cover an arc of about 30° to 70° degrees of the cap with about 40° degrees being preferred.

It will be appreciated that while it is preferred to use a single venting zone 100 which is positioned adjacent to tab means 38, if desired, one or more additional such zones could be provided or a single zone disposed in another location could be employed.

A reason for preferring to have the zone of weakness disposed adjacent to where the tab means 38 and connecting portion 82 meet the cap skirt 61, is that lifting the tab means 38 facilitates immediate venting. This reduces the likelihood of undesired, uncontrolled acceleration of cap removal due to rapid pressure release.

It will be appreciated that the weakened venting zone also facilitates automatic venting and reseating of the cap during container storage after opening and restorage.

Figure 7:
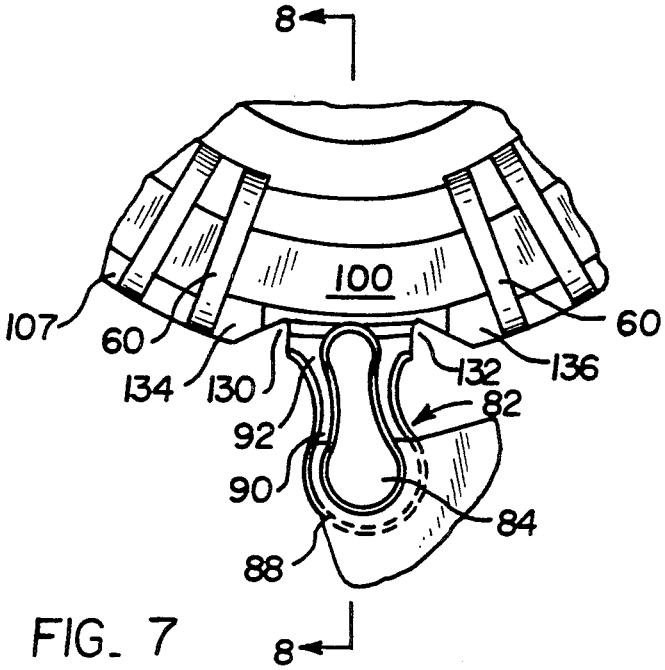
FIG. 7 is a fragmentary plan view of a portion of the tab containing part of the cap of this invention.
Figure 10:
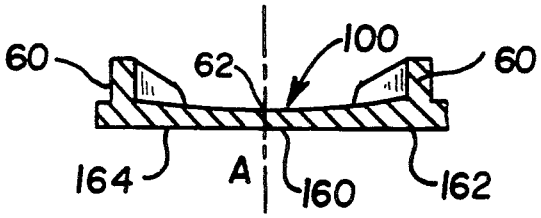
FIG. 10 is a cross-sectional illustration taken through 10—10 of FIG. 8 showing variations in the wall thickness of the cap of the invention.

Referring to FIGS. 6 and 7, further additional means for establishing weakness in region 100 will be considered. The outer wall of skirt 61 may be thinned as this does not alter the size or shape of lip 25 which seals against spout 20. It will be noted that the outside diameter of skirt 61 in the region 100 is less than the outside diameter of skirt 61 about the remainder of the cap 10. Similarly, the portion 62 of the top wall 100 within region 100 may be thinned as shown in FIG. 10.

As also shown in FIG. 6, the annular lip 25 is preferably continuous and has an upper surface 109, a lower surface 110, and a connecting lateral surface 111. The angle which upper surface 109 of lip 25 makes with the horizontal also can be employed to enhance venting. The surface 109 preferably is below horizontal by an angle of about 40° to 50° degrees with about 45° degrees being preferred. The greater the angle, the less resistance to venting is provided. A balance between sealing and venting action is desired.

Figure 5:
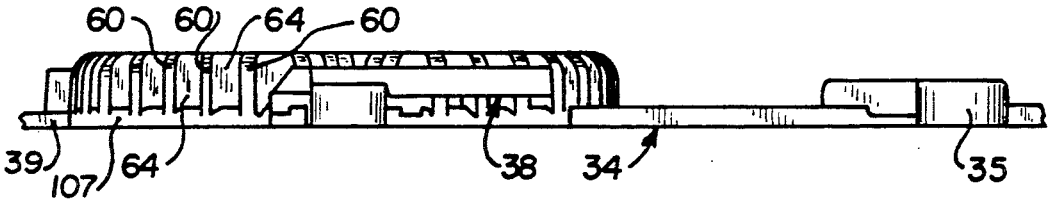
FIG. 5 is an elevational view of a form of the cap of the present invention.

Referring to FIGS. 5 through 7 there is shown a top panel 59 and the depending annular skirt 61. The outwardly projecting flange 107 is preferably substantially continuous throughout the circumference of the cap except for regions closely adjacent to the tab means 38. These discontinuities in flange 107 contribute to the desired weakness in the region of the tab means 38. The portions of the skirt adjacent to the radially innermost portion of the tab 92 of the tab means 38 is substantially devoid of the flange 107, in recesses 130, 132. It is preferred that the flange 107 be substantially completely eliminated in this region, although a slight residual portion may be retained if desired. This deletion serves to terminate the band strength of the annular flange 107 and provide for greater flexibility for venting purposes in the region of the tab means 38.

Referring to FIG. 7 there is shown a detail of the region 100 of the cap 10 which is preferably devoid of ribs 60. It will be appreciated that for some uses it may be desired to use some ribs 60 in region 100, but of lesser concentration, or partial ribs, so as to achieve a degree of weakening less than that illustrated in FIG. 7 (for convenience of reference herein such constructions will be referred to as having fewer ribs than the remainder of the cap).

Figure 9:
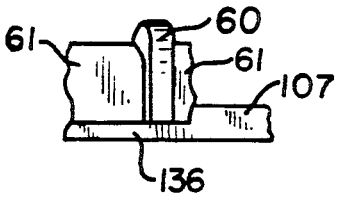
FIG. 9 is a fragmentary elevational view showing a portion of the weakened area of the cap.

Referring to FIGS. 7 and 9, a further feature of the invention will be considered. Regions 134, 136 adjacent to the tab means 38 are flanges which are of lesser thickness than adjacent portions. FIG. 9 shows region 136 in detail with the right portion of skirt 61 adjacent flange 107 broken away for clarity of illustration. The thickness in these regions 134, 136 may be on the order of 0.015 inch as compared with the remainder of the flange being on the order of 0.030 inch. It is preferred that the thinned regions 134, 136 have a thickness about 40 to 60 percent of the average thickness of that of the remainder of the flange 107. This reduction in thickness creates further resiliency in the region of the vent.

Figure 8:
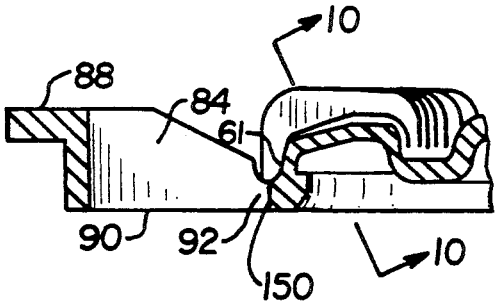
FIG. 8 is a cross-sectional illustration taken through 8—8 of FIG. 7 showing a portion of the tab of the present invention.

It will be noted that the skirt 61 has a relatively small projection 150 in FIG. 8 which defines an inside wall of the central opening 84 through the tab 38. Also, the connecting portion 82 of the tab means 38 has a generally L-shaped configuration in plan and has an overall height of about 0.10 inch. The height of connecting portion 82 is reduced in the portion closest to skirt 61.

Referring to FIGS. 3, 5, 6 and 8, the closure cap 10 is provided with a series of radially extending ribs 60. The ribs 60 preferably extend radially outwardly from a location on the cap 10 which is disposed inwardly of the lip 24 when the cap assembly 10 is disposed in overlying sealing relation with the lip 24. The ribs 60 extend outwardly to a location on the cap assembly 10 which is at or beyond the lip 24 when the cap assembly is disposed in overlying sealing relation with the lip 24. In one preferred embodiment each rib 60 begins at a location adjacent an outer portion of the channel 63 and extends radially outwardly, with a generally planar, interposed, thin top surface 64, to a radial location coterminous with the outside diameter of the body of the cap assembly 10, as shown in FIGS. 1 and 3.

The ribs 60 may be provided at successive locations, such as every 8 to 10 degrees around at least a majority of the circumference of the preferred round cap assembly 10. In one embodiment, the ribs 60 may be successively provided around the entire circumference of such cap assembly 10, but in the preferred embodiment as shown in FIGS. 4 and 7, the region adjacent to tab means 38 will be devoid of ribs 60 or have ribs present to a lesser extent.

In FIG. 4 the closure 10 is provided with ribs 60 around about 290° degrees to 330° of the circumference of the cap assembly 10. In a preferred embodiment the ribs 60 have a circumferential width within the range of from about 0.020 to about 0.030 inch. Each rib 60 has a height which extends above the general plane of the upper surface 62 of the cap assembly 10 as defined by the membrane portions 64 between the alternating ribs 60. In a preferred embodiment, the upper surface of the ribs 60 provide locations having a greater height than the height of the balance of the membrane portions 64 of the cap assembly 10 between the ribs 60. Such rib height, or increased cap assembly thickness, provide a plurality of portions or zones about the circumference of the cap assembly 10 which exhibit less elasticity than the thinner cap assembly membrane portions 64, or zones, between the ribs 60. It will be appreciated by those skilled in the art that the height of the ribs 60 may have to be limited to that height which will not interfere with stable vertical stacking of the containers.

Referring to FIG. 10, there is shown the region of the top wall 59 adjacent to the skirt 61, namely, portion 62 of top wall 100, with the center line A of the tab means 38 having a thickness preferably on the order of 0.015 inch in region 160 and an increased thickness in regions 162, 164 adjacent thereto of about 0.025 inch. This thinning of the region 100 serves to provide weakness and increased flexibility in the region adjacent the tab means 38 in order to facilitate venting action. It is preferred that the region 100 when devoid of ribs have a reduced thickness of about 50 to 70 percent of the average thickness of the regions contacting the two adjacent ribs 60.

The weakening features specifically preferred and disclosed herein include the total absence or partial absence of reinforcing ribs 60 from region 100, the recesses 130, 132 disposed on opposite sides of the tab means 38 through elimination of the flange 107, the reduction of thickness of skirt 61 and top wall portion 62, the alteration of the upper sealing surface of lip 25, the variation in thickness of the top wall 59 in region 100, the reduction in diameter of skirt 61 in adjacent region 100, the reduction in thickness of the flanges in regions 134, 136 and in regions adjacent to the tab means 38, and the generally hourglass configuration of the tab connecting means 88.

Once the predetermined pressure at which venting is desired is determined, one may readily determine if all of these features which provide weakness within region 100 are employed or only some. One skilled in the art may readily make this determination. The venting zone should be sufficiently weakened that local venting in the region of weakness will occur at the predetermined pressure and the cap will reseal automatically after such venting. Also, venting will occur immediately when the tab means are employed to open the reclosed container.

It will be appreciated that the present invention has provided an effective reclosure cap which may be used on large containers, e.g., having a beverage capacity of greater than about 20 ounces, having pressurized contents, such as carbonated beverages which may be soft drinks or beer, for example. The reclosure cap which will serve to resist undesired loss of container contents and the occurrence of potentially hazardous conditions caused by excessive pressure build-up within the container. All of this is accomplished preferably by modification of preexisting reclosure means in a manner not taught or suggested by the prior art through incorporation of a weakened zone in the region adjacent the tab means 38. The tab means 38 are grasped manually to move the reclosure for one position overlying the container wall opening to a storage position.

In the event of excessive internal pressures, the closure will vent automatically in order to exhaust the excessive gas and will automatically reseal itself as a result of elastomeric material out of which the cap is made and the mechanical weakening features. Further, in the event that the internal container pressure is close to the maximum desired pressure, manual engagement and lifting of the tab will result in gradual, safe exhaust of the gas. The invention is, therefore, beneficial both in storing reclosed pressurized containers and in opening such containers.

It has been found that a closure cap 10 of this invention requires sufficient resiliency or flexure to be able to be stretched over the lip 24 of the spout 20 as the cap 10 is being applied. It is also desirable to maximize the sealability of a closure cap 10 after it has been applied in order to provide a structure which does not yield from its sealing engagement when subjected to ordinary, desired internal can pressures.

In operation of the cap 10 of the present invention, the user typically receives a beer or beverage container with a cap 10 disposed remote from the pour spout 20 as shown in FIG. 1. The cap 10, though secured and hinged by a rivet 36 is, in the form shown, also secured by an additional temporary securing mechanism or device, which is created by tab 39 and bubble 40 to prevent undesired rotational movement of the cap assembly 10 during handling prior to consumer use.

In a preferred embodiment, the sealing cap assembly 10 is adapted to be pivotally displaced about the rivet 36 from a first location remote from the opening panel 27 and pouring spout 20 to a second location in overlying, sealing relation with the opening panel 27 and pouring spout 20. When the user intends to open the container, the cap 10 may be rotated or otherwise positioned such that it is disposed directly over the opening panel 27 prior to the digital initiation of fracture of the score line 26 defining the spout 20. A clearly visible pressure point location indicia, such as pressure index 103, may be provided on the cap assembly at a predetermined location on the upper surface of the cap assembly 10. Such pressure index 103 (FIGS. 1 and 3) which may be of rhomboid character and molded on the cap surface. Such pressure point location indicia 103 is located in radial alignment with and above a selectively shaped and located, downwardly projecting boss 106 (FIG. 6) on the undersurface of the closure cap 10 and adjacent to bosses 104, 105.

Bosses 104, 105 and 106 are downwardly projecting extensions. As will be apparent, the bosses 104, 105 and 106 serve to enhance and magnify unit pressures at the point of digital contact to initiate fracture of the score lines 26, 29 when it is desired to gain access to an unopened container. Once initiated, the balance of the fracture of the score lines 26, 29 from one end of the hinge 28 to the other end of the hinge 28 may be attained with relatively minor digital pressure. The reseal cap assembly 10 is typically pivoted away from the pour spout 20 after the score lines 26, 29 has been fractured. As the score lines 26, 29 are fractured, the panel 27 bends inwardly, about the hinge 28, to result in an unobstructed pour spout through which the liquid contents of the container may be poured. As a result of the self-venting feature of the cap of the present invention, the container will have an internal pressure at or under the desired maximum and, thereby a safe, efficient opening will be effective.

After a portion of the contents of the container has been removed, it may be desirable to reseal the container. Such resealing is desirable, for example, to maintain carbonation in a beverage as well as to prevent spillage of the contents and to keep foreign elements from entering the opened container. It will be understood by those skilled in the art that carbonated beverages typically release dissociable gas, i.e., carbonation, unless and until gas equilibrium is reached and maintained. This is accomplished in a container by providing an effective gas-tight seal. The present invention provides a closure cap 10 for providing substantially gas-tight sealing engagement over the lip 24 of an open pour spout 20.

To reseal the container, the cap assembly 10 as shown in FIG. 1 is rotationally pivoted to a portion directly over the pour spout 20. Then, downward pressure is exerted against the upper surface of the cap assembly 10, preferably at locations near the circumferential edges of the cap assembly 10. Such pressure forces a circumferential inwardly facing recess 68 (FIG. 3) in the cap 10 over the circumferential outwardly facing lip 24 of the container wall defining the pour spout 20. It will be appreciated that during the application of such pressure, the elastic zones or membranes 64 in the closure cap 10 yield as required to permit the cap temporarily to expand or deform slightly, as required, to fit over the lip 24 around the circumference or perimeter of the pour spout 20. It will be appreciated by those skilled in the art that the cap material will deform or flex over the lip 24, well within the elastic limit of the cap material. After the elastic membrane 64 has stretched slightly, as downward pressure continues the locking recess 68 in the cap assembly 10 seats against the outwardly projecting lip 24 as the flexed cap returns through its resilience to its unflexed shape. The user will have a positive indication, through sight and through feel, that the cap assembly 10 is disposed in surrounding gas-tight sealing relation with the sealing surface 32 on the lip 24 of the pour spout 20 about the entire circumference of the lip 24.

Once sealed with the closure cap 10, the container is typically, though not exclusively, stored on its base. During storage of such container, gases may become disassociated with the remaining beverage in the container to cause internal can pressures on the order of about 30 to about 60 pounds per square inch or higher to be exerted against the cap assembly 10. When such internal can pressure increases, such pressure may cause the closure cap 10 to flex outwardly somewhat when the internal pressure exceeds the desired upper limit, the weakened portions in region 100 of the cap 10 provided adjacent tab means 38 in accordance with this invention will facilitate outward flexure of the cap in this region. The pressure may move this portion of the cap 10 away from sealed contact with the spout lip 24, thereby venting the excess gas pressure. After this venting action, the cap will automatically reseat itself in sealed position.

When it is desired to regain access to the contents of the resealed container, the user lifts the cap assembly 10. The cap 10 may be lifted such as by grasping an integral tab means 38 between the thumb and forefinger and lifting. It has been found that an inward rolling type motion is desirable to initiate the separation and release of the cap assembly 10 from its engagement under the lip 24 of the pour spout 20. This action will also facilitate immediate venting in weakened region 100.

The alternating radial elastic and less elastic structure of the cap assembly 10, providing circumferentially or parametrically spaced elastic and less elastic portions combined with the weakened regions adjacent the tab means 38, promotes removal of the cap assembly 10 in the same general fashion that facilitates application of the closure cap 10. Once the closure cap assembly 10 has been lifted from the lip 24, the cap 10 may be pivotally rotated about the rivet 36, in those applications in which a rivet 36 is utilized, to provide unobstructed access to the remaining contents of the can through the open pour spout 20. It will be appreciated that multiple resealing operations are comprehended with the cap assembly 10 of this invention as may be necessary or appropriate over the life of a large volume container with which the cap assembly 10 may be utilized.

It will be appreciated, therefore, that the present invention provides effective means for venting a resealed container which contains pressurized contents by providing a local zone of weakness which will deform to permit venting solely in this region and automatically reseal after the desired venting. The weakened zone is preferably disposed on or adjacent to the tab means which are grasped to remove the cap from the container spout.

It will be appreciated that while a preferred combination of features for creating a weakened, vented section has been disclosed, the invention is not so limited and, if desired, one or more of the elements, as well as other weakening zones may be employed so as to provide the self-venting and resealing features of the present invention.

Whereas certain preferred means of providing a weakened zone for venting have been disclosed, other means contributing to such weakening will be apparent to those skilled in the art and may be employed.

While the preferred placement of the weakened zone adjacent to the tab means 38 has been disclosed, other positions may be employed while providing automatic venting during storage of a reclosed container. Immediate venting upon opening through the use of tab means 38 will not be achieved as readily with this latter approach.

While reference has been made herein to positioning containers in a vertical storage position after reclosure, the invention is not so limited. Consumers have been known to store containers on their sides.

While a single weakened zone 100 is preferred, more than one such zone may be provided at different locations on the cap, if desired.

Whereas particular embodiments of the invention have been described above for purposes of illustration, it will be appreciated by those skilled in the art that numerous variations of the details may be made without departing from the invention as described in the appended claims.

I claim:

1. A cap for substantially gas-tight sealing engagement with a container wall having an opening therein circumscribed by a sealing surface, said cap comprising, a top wall and a depending skirt cooperating therewith to define a sealing portion which is sealingly engageable in gas-tight relationship with said sealing surface, means for securing said cap to said container wall, tab means for manually engaging said cap to rotate the same between a sealed position and an unsealed position, said cap having vent means provided by at least one weakened zone, which is disposed on or adjacent to said tab means, whereby said vent means will, when container pressure exceeds a predetermined level, move a portion of said cap away from said sealing surface to vent said container and, subsequently, automatically reestablish sealed contact with said sealing surface, and said cap having only one said weakened zone.

2. The cap of claim 1 including, said cap having a plurality of generally radially oriented relatively circumferentially spaced ribs extending at least to the end of said top wall.

3. The cap of claim 2 including, said ribs extending down said cap skirt.

4. The cap of claim 1 including, said cap being composed of an elastomeric material.

5. The cap of claim 4 including, said cap having circumferentially spaced portions of first elasticity, alternating with second circumferential portions of greater elasticity.

6. The cap of claim 5 including, the portion of said cap adjacent to said tab means being a said second circumferential portion of greater elasticity.

7. A cap for substantially gas-tight sealing engagement with a container wall having an opening therein circumscribed by a sealing surface, said cap comprising, a top wall and a depending skirt cooperating therewith to define a sealing portion which is sealingly engageable in gas-tight relationship with said sealing surface, means for securing said cap to said container wall, tab means for manually engaging said cap to rotate the same between a sealed position and an unsealed position, said cap having vent means provided by at least one weakened zone, disposed on or adjacent to said tab means, whereby said vent means will, when container pressure exceeds a predetermined level, move a portion of said cap away from said sealing surface to vent said container and, subsequently, automatically reestablish sealed contact with said sealing surface, said cap having a plurality of generally radially oriented relatively circumferentially spaced ribs extending at least to the end of said top wall, said ribs extending down said cap skirt, and said weakened zone includes a portion of said top wall adjacent said tab means having fewer said ribs than the remainder of said cap.

8. The cap of claim 7 including, said cap skirt terminating in a generally radially outwardly projecting flange.

9. The cap of claim 8 including, portions of said skirt means disposed within said weakened zone on opposed sides of said tab means being either devoid of said flange or having said flange of lesser outward radial projection than the remainder of said skirt.

10. The cap of claim 9 including, portions of said skirt flange disposed on the opposite sides of said tab means from said reduced flange region having reduced thickness with respect to other portions of said flange.

11. The cap of claim 8 including, portions of said cap within said weakened zone having thinner wall portions than corresponding similar portions of said cap disposed outside said weakened zone.

12. The cap of claim 8 including, at least portions of said outwardly projecting flange within said weakened zone being of reduced thickness with respect to the average thickness of the remainder of said flange.

13. The cap of claim 12 including, the thickness of said reduced thickness flange being about 40 to 60 percent of the average thickness of said remainder of said flange.

14. The cap of claim 8 including, at least portions of said depending skirt disposed within said weakened zone being thinner than the average thickness of the remainder of said skirt.

15. The cap of claim 8 including, at least portions of said cap wall within said weakened zone having a thickness less than the average thickness of said top wall outside said weakened zone exclusive of said ribs.

16. The cap of claim 15 including, a downwardly projecting upwardly open annular rib formed within said top all, and at least a portion of said annular rib disposed within said weakened zone being thinner than the average thickness of similar rib portions disposed outside said weakened zone.

17. The cap of claim 8 including, said tab means having a portion of generally hourglass shape in plan with the longest transverse dimensions being disposed adjacent said cap skirt ant adjacent said manually engageable means.

18. The cap of claim 17 including, said tab means including a manually engageable portion and connecting means connecting said manually engageable portion to the remainder of said cap, and said hourglass shape being in said connecting means.

19. The cap of claim 18 including, said cap securing means projecting generally radially from said cap skirt and having means for rotational, mechanical interengagement with said container wall, and said tab means connected to said skirt means at a position about 80° to 100° degrees circumferentially displaced from said container engaging arm.

20. The cap of claim 8 including, the inner surface of said depending skirt having an inwardly projecting annular rib for sealed engagement with said container sealing surface, said annular rib having an upper surface, a lower surface, and a connecting lateral surface, said upper surface sloping generally downwardly and radially inwardly at angle of about 40° to 50° degrees with the horizontal.

21. A cap for substantially gas-tight sealing engagement with a container wall having an opening therein circumscribed by a sealing surface, said cap comprising, a top wall and a depending skirt cooperating therewith to define a sealing portion which is sealingly engageable in gas-tight relationship with said sealing surface, means for securing said cap to said container wall, tab means for manually engaging said cap to rotate the same between a sealed position and an unsealed position, said cap having vent means provided by at least one weakened zone disposed on or adjacent to said tab means, whereby said vent means will, when container pressure exceeds a predetermined level, move a portion of said cap away from said sealing surface to vent said container and, subsequently, automatically reestablish sealed contact with said sealing surface, said cap having a plurality of generally radially oriented relatively circumferentially spaced ribs extending at least to the end of said to wall, said ribs extending down said cap skirt, and said weakened zone includes said portion of said top wall adjacent said tab means being substantially devoid of said ribs.

22. A cap for substantially gas-tight sealing engagement with said container top wall pivotally secured to said container wall comprising:

said cap having a top wall and depending skirt defining a sealing portion which is sealingly engageable with said container wall sealing surface, said cap having manually engageable tab means for engaging and moving said cap, said cap composed of an elastomeric material and having alternating first zones of a first elasticity and second zones of a second elasticity with said second elasticity being greater than said first elasticity, vent means provided on or adjacent to said tab means for local venting when the containers's internal pressure exceeds a predetermined level, said venting means including a weakened zone within said cap, and said weakened zone includes a portion of said top wall adjacent said tab means having fewer said ribs than the remainder of said cap.

23. A cap for substantially gas-tight sealing engagement with said container top wall pivotally secured to said container wall comprising, said cap having a top wall and depending skirt defining a sealing portion which is sealingly engageable with said container wall sealing surface, said cap having manually engageable tab means for engaging and moving said cap, said cap composed of an elastomeric material and having alternating first zones of a first elasticity and second zones of a second elasticity with said second elasticity being greater than said first elasticity, vent means provided on or adjacent to said tab means for local venting when the container's internal pressure exceeds a predetermined level, said venting means including a weakened zone within said cap, and said weakened zone includes said portion of said top wall adjacent said tab means being substantially devoid of said ribs.

24. The cap of claim 23 including, said cap skirt terminating in a generally radially outwardly projecting flange.

25. The cap of claim 23 including at least portions of said depending skirt disposed within said weakened zone being thinner than the average thickness of the remainder of said skirt.

26. A cap for substantially gas-tight sealing engagement with said container top wall pivotally secured to said container wall comprising, said cap having a top wall and depending skirt defining a sealing portion which is sealingly engageable with said container wall sealing surface, said cap having manually engageable tab means for engaging and moving said cap, said cap composed of an elastomeric material and having alternating first zones of a first elasticity and second zones of a second elasticity with said second elasticity being greater than said first elasticity, vent means provided on or adjacent to said tab means for local venting when the container's internal pressure exceeds a predetermined level, said venting means including a weakened zone within said cap, said cap being composed of an elastomeric material, said cap skirt terminating in a generally radially outwardly projecting flange, and portions of said skirt means disposed within said weakened zone on opposed sides of said tab means being either devoid of said flange or having said flange of lesser outward radial projection than the remainder of said skirt.

27. The cap of claim 26 including, portions of said cap within said weakened zone having thinner wall portions than corresponding similar portions of said cap disposed outside said weakened zone.

28. A container-cap combination comprising a container having a top wall provided with a panel which when opened permits access to the container's contents through an opening therein circumscribed by a sealing surface, a cap adapted for gas-tight sealing engagement with said container top wall, said cap having a top all and depending skirt defining a sealing portion which is sealingly engageable with said container wall sealing surface, said cap having manually engageable tab means for engaging and moving said cap, said cap composed of an elastomeric material and having alternating first zones of a first elasticity and second zones of a second elasticity with said second elasticity being greater than said first elasticity, vent means provided on or adjacent to said tab means for local venting when the container's internal pressure exceeds a predetermined level, said closure skirt terminating in a generally radially outwardly projecting flange, and portions of said skirt adjacent said tab means having said flange of reduced thickness with respect to remaining portions of said flange.

29. The container-cap combination of claim 28 including, portions of said cap within said weakened zone having thinner wall portions than corresponding similar portions of said cap disposed outside said weakened zone.

30. The cap of claim 29 including, said first zone having generally radially oriented ribs, and said second zone being either devoid of said ribs of having lesser ribs in number, or radial extent, or both.

31. The container-cap combination of claim 28 including, at least portions of said outwardly projecting flange within said weakened zone being of reduced thickness with respect to the average thickness of the remainder of said flange.

32. The container-cap combination of claim 28 including, at least portions of said depending skirt disposed within said weakened zone being thinner than the average thickness of the remainder of said skirt.

33. The container-cap combination of claim 28 including, at least portions of said cap wall within said weakened zone having a thickness less than the average thickness of said top wall outside said weakened zone exclusive of said ribs.

34. The container-cap combination of claim 33 including, a downwardly projecting upwardly open annular rib formed within said top wall, and at least a portion of said annular rib disposed within said weakened zone being thinner than the average thickness of similar rib portions disposed outside said weakened zone.

35. The container-cap combination of claim 28 including, said tab means having a portion of generally hourglass shape in plan with the longest transverse dimensions being disposed adjacent said cap skirt and adjacent said manually engageable means.

36. A container-cap combination comprising, a container having a top wall provided with a panel which when opened permits access to the container's contents through an opening therein circumscribed by a sealing surface, a cap adapted for gas-tight sealing engagement with said container top wall, said cap having a top wall and depending skirt defining a sealing portion which is sealingly engageable with said container wall sealing surface, said cap having manually engageable tab means for engaging and moving said cap, said cap composed of an elastomeric material and having alternating first zones of a first elasticity and second zones of a second elasticity with said second elasticity being greater than said first elasticity, vent means provided on or adjacent to said tab means for local venting when the container's internal pressure exceeds a predetermined level, said closure skirt terminating in a generally radially outwardly projecting flange, and portions of said skirt flange adjacent to said tab means being either of reduced radial extent or being totally eliminated.

37. The cap of claim 36 including, said tab means having a manually engageable portion and a connecting portion secured to said cap skirt.

38. The cap of claim 36 including, said vent means having the top of said cap having regions of varying thickness adjacent to said tab means.

39. The container-cap combination of claim 38 including, the inner surface of said depending skirt having an inwardly projecting annular rib for sealed engagement with said container sealing surface, said annular rib having an upper surface, a lower surface, and a connecting lateral surface, said upper surface sloping generally downwardly and radially inwardly at angle of about 40° to 50° degrees with the horizontal.

40. The cap of claim 36 including, said top wall regions having a central portion of lesser thickness than adjacent portions.

41. A container-cap assembly for a container comprising, a container end wall having a score line defined removable paned, removal of which establishes a pour opening, said container end wall having an upwardly projecting continuous sealing surface surrounding said pour opening, a resealing cap rotatably secured to said container end wall and adapted to assume a first position in overlying gas-tight sealing relationship with respect to said container sealing portion, said cap comprising, said cap having a top wall and a depending skirt which cooperates therewith to define a sealing portion which is sealingly engageable in gas-tight relationship with said sealing surface, said cap having means for securing said cap to said container wall, said cap having tab means for manually engaging said cap to rotate the same between a sealed position and an unsealed position, said cap means having vent means defined by a weakened zone disposed on or adjacent to said tab means, said cap having a plurality of generally radially oriented relatively circumferentially spaced ribs ext ending at least to the end of said topwall, said ribs extending down said cap skirt, and a portion of said top wall adjacent said tab means having fewer said ribs than the remainder of said cap.

42. The container-cap assembly of claim 41 including, said cap skirt terminating in a generally radially outwardly projecting flange, and portions of said skirt means on opposed sides of said tab means being either devoid of said flange or having said flange of lesser outward radial projection than the remainder of said skirt.

43. The container-cap assembly of claim 42 including, portions of said skirt flange disposed on the opposite sides of said tab means from said reduced flange region having reduced thickness with respect to other portions of said flange.

44. The container-cap assembly of claim 43 including, said tab means including a manually engageable portion and connecting means connecting said manually engageable portion to the remainder of said cap, and said tab means connecting means having a generally hourglass shape in plan with the largest peripheral dimensions being disposed adjacent said cap skirt and adjacent said manually engageable means.

45. The container-cap assembly of claim 42 including, said weakened portion of said top wall having a central wall thickness which is less than adjacent wall thicknesses on both sides.

46. The container-cap assembly of claim 41 including, said cap skirt terminating in a generally radially outwardly projecting flange, and said weakened zone being established by providing at least two or more of the following variations within said weakened zone, (a) the absence of portions of said outwardly projecting flange, (b) reduced thickness of portions of said outwardly projecting flange, (c) thinner portions of said cap skirt, (d) thinner portions of said cap top wall, (e) said tab means having a generally hourglass shape, and (f) said skirt sealing portion having an inwardly projecting annular rib that has an upper surface sloped generally downwardly and radially inwardly at an angle of about 40° to 50° degrees with respect to the horizontal.

* * * * *